United States Patent [19]

Brown

[11] 3,945,146

[45] Mar. 23, 1976

[54] GYROSCOPIC TOP

[76] Inventor: Paul L. Brown, 982 Lakeview Way, Redwood City, Calif. 94062

[22] Filed: Jan. 10, 1975

[21] Appl. No.: 540,131

[52] U.S. Cl. ..... 46/50; 46/67
[51] Int. Cl.[2] ..... A63H 1/04
[58] Field of Search ..... 46/50, 65, 67, 66

[56] References Cited

UNITED STATES PATENTS

| | | | |
|---|---|---|---|
| 1,535,502 | 4/1925 | Southwell | 46/50 |
| 2,456,341 | 12/1948 | Thoresen | 46/66 |
| 2,610,440 | 9/1952 | Manske et al. | 46/65 |
| 3,365,835 | 1/1968 | Grow | 46/50 |

*Primary Examiner*—Louis G. Mancene
*Assistant Examiner*—Robert F. Cutting

[57] ABSTRACT

A gyrotype toy top embodying a casing housing a rotor on a shaft having a spinning tip thereon, and a biased combined starter element and clutch member for effecting the engagement of the clutch member with the rotor upon the application of a pulling force to one section of a cord extending exteriorly of the casing to unwind a tensioned section of the cord pre-wound on the starter element whereby to initiate the spinning of the top.

5 Claims, 7 Drawing Figures

FIG. 1
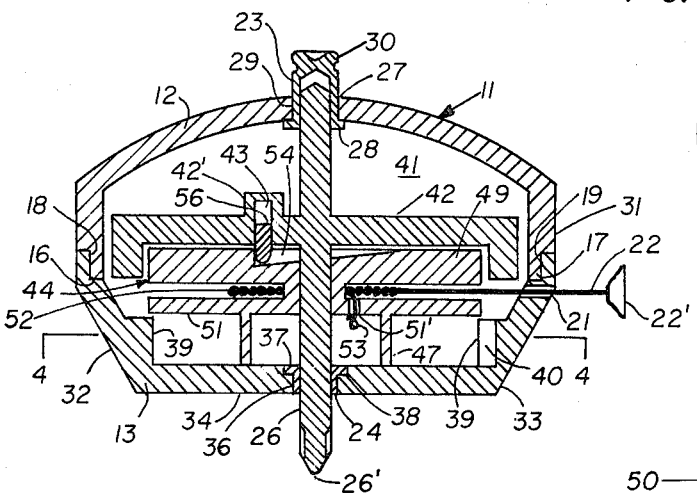
FIG. 2
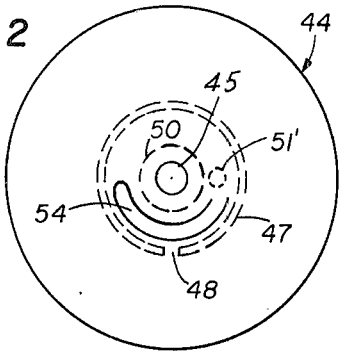
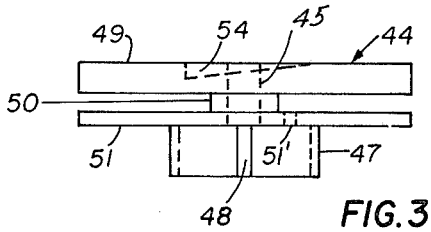
FIG. 3
FIG. 5
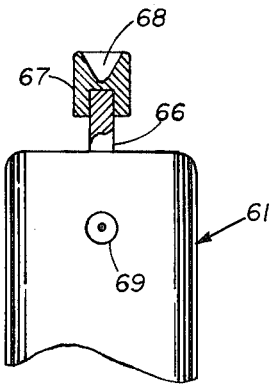
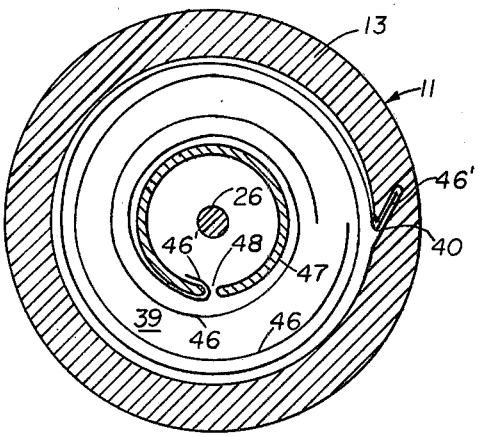
FIG. 4
FIG. 6
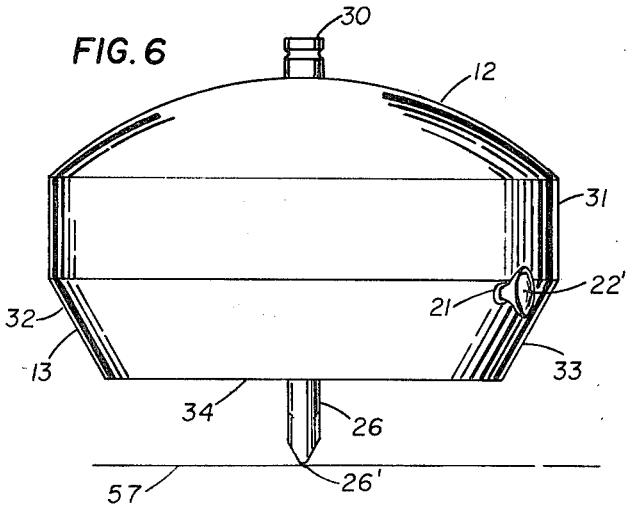
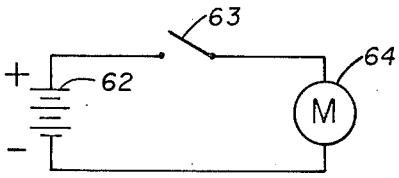
FIG. 7

GYROSCOPIC TOP

The present invention generally relates to gyrotype toys, and more particularly relates to spinning or spinable toy tops of the general nature described and claimed in my U.S. Pat. No. 3,523,386, issued to me on Aug. 11, 1970 and entitled SPINABLE SPRINGLESS TOP.

Prior to this time there have been issued a number of Letters Patent of the United States disclosing operative spinning tops employing a member variously described as a momentum wheel, or rotor, a balance-wheel or cup-shaped rotor portion which is caused to be rotated by means of a cord. Among these prior patents are the U.S. Pats. to J. N. Cayo, No. 1,363,718 issued Dec. 28, 1920; to W. E. Doljan, No. 2,762,162, issued Sept. 11, 1956; to Wingert, No. 1,109,562, issued Sept. 1, 1914; to J. A. Irving, No. 814,962, issued Mar. 13, 1906; and to O. Thoresen, No. 2,456,341, issued Dec. 14, 1948. While the present invention is directed generally to the subject matter of the foregoing prior patents, there are fundamentally different components and positionings and arrangements of the various components so embodied in applicant's invention which effectively provides a less expensive as well as more advantageously operable toy, not only reducing the complexity and assembly of the components but also reducing to a minimum the manufacturing expense of these types of gyroscopic tops. Further, applicant's invention attains an attractive readily playable top which is not dangerous to use nor hazardous in any manner to onlookers enjoying the playing of the top.

A primary object of my present invention is to provide an improved gyroscopic top which affords a really novel toy that is not prohibitive in cost and that can be enjoyed by the young without liklihood of injury to themselves or to bystanders.

Another important object of the invention is to provide an improved gyroscopic top of the indicated nature, which is additionally characterized by its capability of being actuated by a pull-cord or by an external booster.

A further object of the present invention is to provide an improved gyroscopic top of the aforementioned character which is positive in its drive action after its initial starting actuation.

A still further object of my present invention is to provide an improved gyroscopic top that is capable of spinning on either of its longitudinally spaced tips.

Other objects of the invention, together with some of the advantageous features thereof, will appear from the following description of an embodiment thereof illustrated in the accompanying drawings which is an exemplification of the best mode of construction of the invention, and the manner of using the same. The appended claims are intended to cover the embodiment illustrated as well as variations thereof within the scope and purview of the invention.

Referring to the drawings:

FIG. 1 is a sectional elevation view of an embodiment of the invention as exemplified in a spinable toy top with the starter cord extended.

FIG. 2 is a top plan view of the starter and clutch component embodied in the invention.

FIG. 3 is a schematic elevational view of the component shown in FIG. 2.

FIG. 4 is a cross-sectional view of the embodiment of my invention shown in FIG. 1 and taken on the line 4—4 thereof, this view showing an employed leaf spring in broken section.

FIG. 5 is a fragmentary elevational view of an energy booster unit with a sectional elevational view of a socket starter attachment for removable engagement with the rotatable shaft of my improved toy top.

FIG. 6 is a front elevational view of the embodiment of my invention shown in FIG. 1, this view showing the upright spinning position of the toy top on a planar surface.

FIG. 7 is a schematic diagrammatic view of the electrical circuit of the booster unit illustrated in FIG. 5.

In its preferred and best mode of construction, the gyroscope top of my present invention comprises a casing in which are housed a vertically arranged rotatable shaft having tapered spinning tips on opposite ends thereof, a rotor on said shaft having a first clutch element thereon, together with a starter supported in surrounding relation to said shaft, a second clutch element movably mounted on said starter, and a pull cord having a pre-wound portion on said starter and a grip portion extending exteriorly of said casing for effecting an initial rotation of said starter to move said second clutch element into engagement with said first clutch element thereby to revolve said rotor and said shaft and to give spinning action to the top, release of said grip portion of said cord effecting the rewinding of said pre-wound portion thereof on said starter and the stopping of the latter with said clutch elements in full engagement for positive gyro movement of the toy for protracted periods of time.

A modified embodiment of the invention comprises all of the components set forth with respect to the above described preferred embodiment, and a socket member mounted on the top of said rotatable shaft for stacking a number of tops one upon another with the bottom of said rotatable shaft disposed in the socket of said socket member.

As illustrated in FIG. 1 of the annexed drawings my gyroscopic top is so constructed as to provide an outer casing 11 which can be fabricated in two detachably connected sections 12 and 13 from a suitable lightweight metal such as aluminum or which can be molded from a suitable plastic material such as a phenol or urea condensate. In molding or fabricating the casing 11, I conveniently fashion the same with annular exterior and interior shoulders 16 and 17, respectively, for seating annular exterior and interior flanges 18 and 19 respectively which engages one another when the sections are brought together in detachable interlocking engagement which can be sealed, if desired. In one of the detachably connected sections, say casing section 13, I provide an opening 21 for passing a starter cord 22 which conveniently is made of an appreciably durable unravelable twine such as a cord made of Nylon or a Coir twine made from the fibers of cocoanuts.

Casing sections 12 and 13 support at their transverse centers a pair of axially aligned friction bearings 23 and 24 for rotatably mounting a vertically arranged rotatable shaft 26 having a pointed tip 26' at one extremity thereof upon which the top can be caused to spin. A convenient fashioning of casing section 12 for supporting friction bearing 23 comprises a centrally located hole 27 into which the bearing 23 is press-fitted with an annular flange 28 of the bearing abutting the hole-bounding portion 29 of casing section 12. It is to be noted that bearing 23 is formed with a socket extension 30 so that whenever desired a second spinning top can be stacked on casing 11 with the pointed tip of such second top seated in the socket extension 30 which, as shown in FIG. 1 projects beyond the external surface of casing 11. One or more of the tops can be so stacked so that a columnar series of spinning tops can be stacked with the lowermost top spinning on the pointed tips 26′ of shaft 26 and the uppermost stacked tops spinning on the sockets of the bearing extensions 30.

It is to be especially observed that the casing section 12 is so formed as to afford a wide annular exterior band 31 thereon which defines a flat surface upon which the top may be caused to roll in a linear direction or a member of different linear directions along a planar surface instead of spinning on the tip 26′ of shaft 26, whenever desired. It also is to be noted that casing section 13 is formed with converging walls 32 and 33 merging with a flat bottom 34 having a central hole 36 therein, in axial alignment with the central hole 27 in casing section 12 through which the vertically arranged shaft 26 extends; the bottom 34 serving to support the bearing 24 which is press-fitted into the hole 36 with the annular flat bottom 37 of the bearing 24 seated on a formed shoulder 38 in the bottom 34. Casing section 13 also is formed with an inner annular extension 39 having a passage 40 therein for a purpose hereinafter explained.

In accordance with the present invention, the casing 11 is constructed to a sufficient size as to define a relatively large inner chamber 41 for housing the operating components of my improved gyroscopic top, including the vertically arranged shaft 26 and a rotor 42 which can conveniently be molded or cast integral with shaft 26 and formed with a boss 42′ thereon having a cavity 43 therein to serve as a first or female clutch member; such rotor having a dimension which is just short of the inner diameter of section 12 of the casing, as clearly shown in FIG. 1 of the annexed drawings.

The interior chamber 41 of the two casing sections 12 and 13 also houses a starter element, generally designated by the reference numeral extension 39 which has a central opening 45 therein for passing shaft 26 and which is mounted for oscillation about such vertical shaft. While any suitable means may be employed for mounting the starter element 44 in operative position, I preferably use a flat coiled spring 46 which is anchored between the inner annular extension 39 of casing 13 and the starter element. The flat coil spring is shown in broken view in FIG. 4 of the annexed drawings with one end thereof, indicated by the reference numeral 46′, turned upon itself and extended into passage 40 of the inner extension39 to bear against the same, and with its convolutions wound about a split-sleeve 47 and with its other end inserted through defined space 48 of the split-sleeve to bear against the inner surface thereof. As an integral unit, the starter element 44 of my present improvement comprises an upper plate 49, a hub 50 and a lower plate 51, from which the split-sleeve 47 depends, and includes a portion 52 of the starter cord 22 pre-wound in convolutions about the hub 50 with the inner end of the cord 22 extending through a hole 51′ of the lower plate 51 and knotted, as indicated at 53, to prevent the cord from being pulled entirely out of the casing 11 when starting the spinning of the top. As illustrated in FIGS. 1 and 2, upper plate 49 of starter element 44 is formed with an inclined arcuate race 54 in its upper surface in which a male clutch member 56 is moved during starting operations; such male clutch member 56 being in the form of a sphere, if desired, or in the form of a cylindrical pin, as shown. The deeper end of inclined race 54 is, with all components at rest, in alignment with the cavity 43 of rotor 42 and, as clearly chown in FIG. 1, the male clutch member is disposed partially with the female clutch member 43 and extends into the race 54 to seat at its deepest end.

To start the spinning action, the cord 22 is pulled away or outwardly from casing 11 and immediately released by the person playing with the top. This will cause relative movement between the starter element 54 and the gyro 42 whereby the starter element 44 initially moves counter-clockwise with the unwinding of cord portion 52 from the hub 50 and then upon release of the cord 22 the starter element moves clockwise and returns to its original or rest position under the influence of spring 46. A small button 22′ on the outer end of cord 22 facilitates grasping and pulling the starter cord outwardly; such button 22′ serving as a stop when the cord 22 is released with the button 22′ engaging the outer surface of casing section 13. Upon releasing of starter cord 22, the male clutch element is caused to move up the arcuate race 54 in the upper surface of upper plate 49 of the starter to enter entirely into the female clutch member 43 where it is retained with the bottom of the pin or male clutch member 56 engaging the upper surface of the plate 49 outside the race 54 therein. As the momentum of the gyro increases it frictionally rotates the casing 11 and the shaft 26 with its spinning tip 26′ spinning on a flat surface 57, or in the alternative rolling on the flat band portion 31 of the connected casing sections 12 and 13. In such spinning or rolling action, the starter element 44 also rotates inasmuch as it is connected with casing section 13 by means of the flat spring 46 with the depending split-sleeve 47 riding on the inner surface of the bottom 34 of casing section 13. The casing 11 can thus be rotated or spun for protracted periods of time.

In FIGS. 5 and 6 of the accompanying drawings, I have illustrated in fragmentary showing a power actuator, generally designated by the reference numeral 61, which includes an electrical circuit comprising a battery 62 for supplying electrical energy when battery contacts are engaged as indicated by closable switch 63, to an electrical motor 64 havings its rotatable shaft 66 extending from the actuator casing. I detachably mount on shaft 66 a relatively short sleeve 67 having a socket 68 therein for receiving the pointed tip 26′ of shaft 26 of the casing 11. Upon closing switch 63 by pressing actuator button 69, the shaft 26 is quickly rotated causing the clutch members to engage to spin rotor 42. Only instant application of socket sleeve 67 to the shaft 26 is necessary to initiate the start of the rotor, and the power actuator is quickly withdrawn or released from the shaft 26 to cause the gyro action of rotor 42.

It is to be understood that the appended claims are intended to cover the embodiment illustrated as well as variations thereof within the scope and purview of the present invention.

I claim:

1. A gyroscopic top comprising a hollow casing, a starter element mounted for oscillation within said casing, a coil spring connected to and wound about said starter element and connected to said casing, a male clutch member on said starter element, a starter cord having a portion thereof pre-wound on said starter element and having a finger-grip portion thereof projecting outside of said casing, a vertically arranged shaft mounted for rotation in said casing, said shaft having a spinning tip thereon, a rotor on said shaft, and a female clutch member on said rotor; exertion of an outward pulling force on said finger-grip portion of said starter cord effecting the unwinding of pre-wound portion of said cord and the simultaneous movement of said starter element in one direction of oscillation to engage said male clutch member with said female clutch member thereby to effect positive rotation of said rotor and the spinning tip of said shaft, release of said finger-grip portion of said cord effecting movement of said starter element in the opposite direction of oscillation to return the same to its initial position under the influence of said coil spring and the simultaneous re-winding of said portion of said starter cord on said starter element for subsequent activation.

2. A gyroscopic top as set forth in claim 1 wherein said starter element has an inclined arcuate race therein for movably seating said male clutch member and engaging said male clutch member with said female clutch member upon the outward pulling of said finger-grip portion of said starter cord.

3. A gyroscopic top as set forth in claim 2 wherein said male clutch member comprises a component normally loosely confined within said female clutch member with the bottom of said male clutch member seated in the deepest part of said race to be urged into full engagement with said female clutch member upon counter-clockwise movement of said starter element.

4. A gyroscopic top as set forth in claim 1 wherein said female clutch member comprises a hollow boss on said rotor defining a cavity for receiving said male clutch member.

5. A gyroscopic top as set forth in claim 1 wherein said casing defines an annular band portion on the exterior surface thereof upon which the top can be moved by gyroscopic rotation of said rotor in a number of linear directions on a flat surface.

* * * * *

UNITED STATES PATENT OFFICE

CERTIFICATE OF CORRECTION

Patent No. 3,945,146 Dated March 23, 1976

Inventor(s) Paul L. Brown

It is certified that error appears in the above-identified patent and that said Letters Patent are hereby corrected as shown below:

Column 3, line 14, "member" should read -- number --.

Column 3, line 41, "39" should be -- 44 --.

Column 3, line 41, "extension" should be deleted.

Column 4, line 6, "with" should be -- within --.

Signed and Sealed this twenty-ninth Day of June 1976

[SEAL]

Attest:

RUTH C. MASON
*Attesting Officer*

C. MARSHALL DANN
*Commissioner of Patents and Trademarks*